US005904105A

United States Patent [19]

Pappinen

[11] Patent Number: 5,904,105

[45] **Date of Patent: *May 18, 1999**

[54] DEVICE FOR COMBUSTION OF MOIST FUEL

[76] Inventor: Matti Pappinen, Partalantie 59, FIN-83780 Horsmanaho, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/722,077

[22] PCT Filed: Apr. 7, 1995

[86] PCT No.: PCT/FI95/00192

§ 371 Date: Nov. 5, 1996

§ 102(e) Date: Nov. 5, 1996

[87] PCT Pub. No.: WO95/29366

PCT Pub. Date: Nov. 2, 1995

[30] Foreign Application Priority Data

Apr. 20, 1994 [FI] Finland ..... 941818

[51] Int. Cl.[6] ..... F23G 5/02

[52] U.S. Cl. ..... 110/226; 110/246; 110/257; 432/107; 432/112

[58] Field of Search ..... 110/224, 226, 110/246, 342, 257; 432/103, 105, 107, 112

[56] References Cited

U.S. PATENT DOCUMENTS

| | | | |
|---|---|---|---|
| 562,845 | 6/1896 | McGiehan . | |
| 2,500,553 | 3/1950 | Lykken | 432/105 X |
| 2,577,659 | 12/1951 | Knipping | 110/226 |
| 3,618,540 | 11/1971 | Wenger et al. | 110/226 |
| 4,060,042 | 11/1977 | Baraldi et al. | 110/224 X |

FOREIGN PATENT DOCUMENTS

| | | |
|---|---|---|
| 564236 | 11/1932 | Germany . |
| 4122157 | 1/1992 | Germany . |

*Primary Examiner*—Henry Bennett
*Assistant Examiner*—Susanne C. Tinker
*Attorney, Agent, or Firm*—Pillsbury Madison & Sutro LLP

[57] ABSTRACT

A device for combustion of moist fuel includes a combustion chamber with a moving fire grate disposed at a bottom portion thereof and a drum dryer located within the combustion chamber above the fire grate. The dryer drum rotates and includes therein an involuted drum in communication with a feeding apparatus external to the combustion chamber. The feeding apparatus transports fuel from a bin to the involuted drum. As the drum dryer rotates the fuel therein moves toward an end thereof and is dried by the heat of the combustion chamber. From an end of the drum dryer, the dried fuel falls onto the fire grate and is burned.

6 Claims, 1 Drawing Sheet

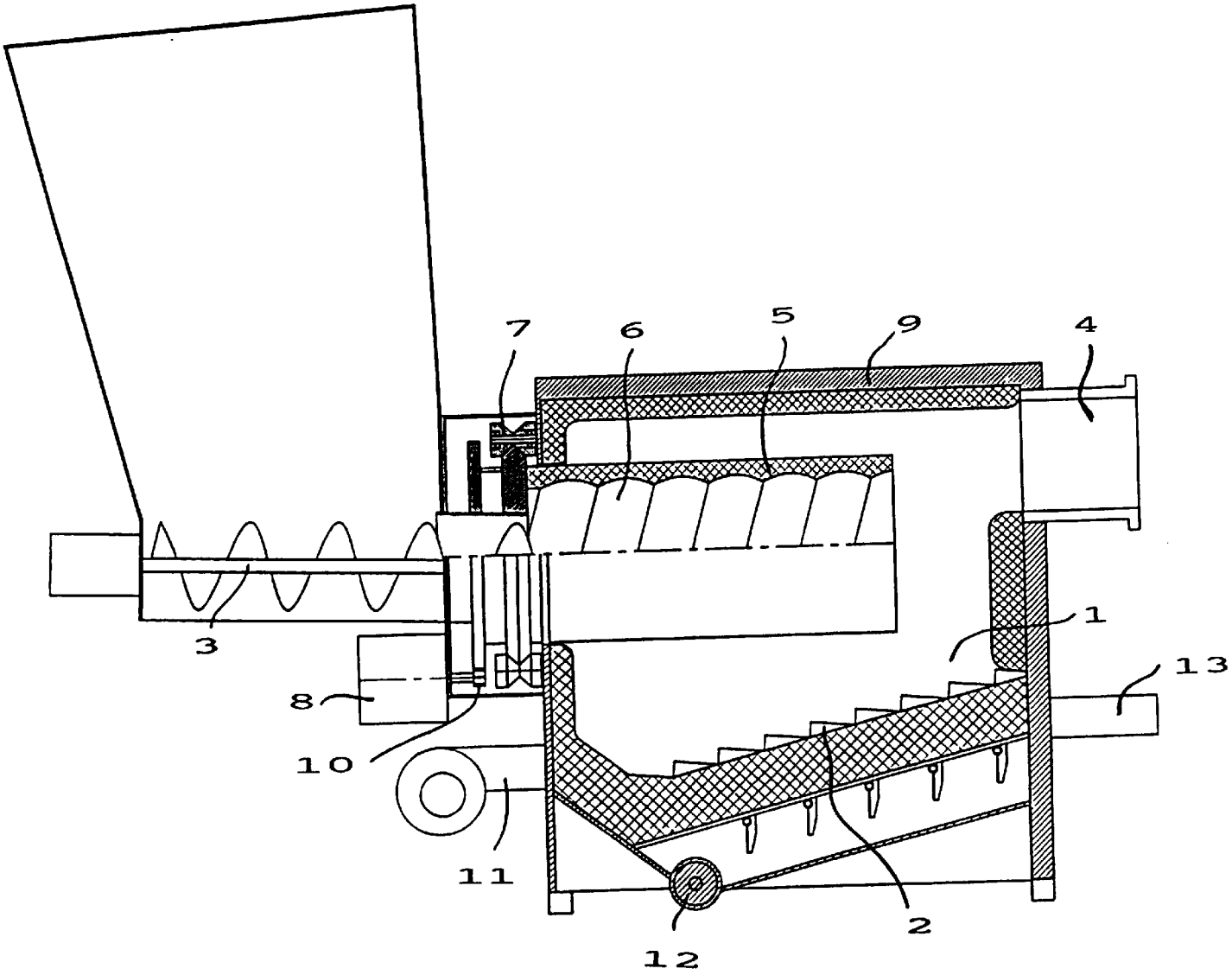
13
4
1
9
2
5
12
6
7
11
10
8
3

DEVICE FOR COMBUSTION OF MOIST FUEL

This application is the national phase of international application PCT/Fl95/00192 filed APR. 7, 1995 which designated the U.S.

BACKGROUND AND SUMMARY OF THE INVENTION

The present invention relates to a device for combustion of moist fuel in which a fire grate, on top of which the fuel burns, is mounted inside a combustion chamber. The mechanical arrangement is also provided with a fuel-feeding apparatus and a discharge channel for removing flue gas from the combustion chamber.

The humidity of the organic fuel such as wood chips and turf or the like used in combustion plants is generally too high for direct feeding from the storage into the combustion device. Such fuels are first dried in a separate desiccator and then fed into the combustion device using a separate feeding apparatus. A separate desiccator is expensive and consumes energy. Desiccation, as well as transfer to and away from the desiccator are all separate stages of the process, and each of them increases the processing expenses of the fuel.

In addition, the currently available combustion devices share the problem that even though the fuel is desiccated, it is still so damp that a long fire grate is necessary for successful combustion. The fuel is shifted along the grate, desiccating at the beginning and burning further away on the grate. A long grate requires a long combustion chamber, increasing the costs of the combustion device. The combustion process in large thermal power stations which use moist chip fuel, even up to 65 per cent in humidity, is based on long fire grates and ceramic masonry, enabling efficient evaporation, desiccation and combustion of the fuel. In order to burn properly, the fuel for currently existing small-sized boilers, front end furnaces and stokers must not exceed 35 per cent in humidity.

The purpose of the invention is to introduce a device for combustion of moist fuel, at the same time remedying defects of the currently available devices. Primarily, the purpose is to introduce a device with which no separate desiccator is needed and in which the fuel can be fed into the combustion chamber moister than in the currently available small-sized boilers or similar devices. Further, the purpose is to introduce a device in which the fuel does not need as many transferring stages as compared to the currently available devices, and, in which the combustion chamber and the fire grate are relatively short.

The purpose of the invention will be achieved with a device which is characterized in what has been stated in the patent claims.

The device constructed in accordance with the invention is provided with a drum dryer which is attached to a feeding apparatus and from which fuel is fed directly onto the grate. When the drum dryer is mounted inside the combustion chamber, the temperature inside the dryer is so high that the fuel fed in it dries effectively before it drops onto the grate. Thus, no separate dryer is needed, and the fuel need not be separately fed into nor removed from the dryer. Fuel processing costs will thus reduce and energy will be saved. Furthermore, the fuel dropping onto the fire grate will be so dry that the grate is no longer needed for desiccating the fuel, thus making it possible to use a relatively short grate. The combustion chamber can efficiently use fuel the humidity of which is approximately in the range of 35 to 55 per cent. One advantage is also that the device collects and utilizes the evaporation energy used in desiccating the fuel, increasing the efficiency of the device.

In an inexpensive application of the device the drum dryer is provided with an inner part with an involuted spiral directed towards the combustion chamber. The involuted structure allows unobstructed advancing movement of the fuel. At the same time, the fuel is constantly mixing and desiccating very efficiently. The transition distance of the fuel is $\pi$ times the internal diameter of the drum times the number of rising spirals, thus making the transition distance very long even in a relatively short drum dryer.

In another inexpensive further application the device is provided with external bearers for the drum dryer and with an actuator for running the dryer. When mounted outside the combustion chamber, the apparatuses are easy to service.

In accordance with the invention, the fire grate is mounted in a diagonal position, and the end of the drum dryer mounted in the combustion chamber reaches a position right above the upper end of the fire grate. In this arrangement the fuel will shift downwards from the position where it is being fed, thus allowing secure forward movement of the fuel on the grate and as well as constant combustion.

In addition, one application of the invention is provided with a fire grate consisting of several components in a step-by-step arrangement that are movable in order to shift the fuel from one part to another. Such an application allows easy transition of the fuel in the combustion chamber.

DESCRIPTION OF THE DRAWINGS

In the following, the invention will be described in further detail with reference to the accompanying figure, which is a schematic elevation in cross section of the apparatus of the present invention.

DETAILED DESCRIPTION OF THE PREFERRED EMBODIMENT

In the illustrated application shown in the figure, the device consists of the following parts: machine bed 9 inside which there is a combustion chamber 1, fire grate 2 inside the combustion chamber 1, feeding apparatus 3, discharge channel 4, and drum dryer 5. The fire grate 2 is situated at the bottom of the combustion chamber 1, and in this application it is made of components which step by step lead downwards and have been attached onto an endless band or a corresponding device. The endless band is run using an actuator 13. The feeding apparatus 3 is placed in front of the machine bed 9 and the combustion chamber 1, and it consists of a feeding bin or similar device and a conveyor placed at the bottom of it, being a feed screw in this application. The feed screw partly reaches both the machine bed 9 and the drum dryer 5, and thus drops the fuel at the beginning of the spiral structure.

The drum dryer 5 is provided with an involuted drum 6 placed above the fire grate. The head of the drum dryer inside the combustion chamber reaches the upper end of the fire grate so that the fuel drops from the drum drier right on top of the fire grate. The inner surface of the drum dryer is made of metal or coated with some applicable ceramic material. In addition, the drum dryer can be provided with external heat brackets which efficiently store heat.

The device is provided with bearers 7 for the drum dryer 5 placed outside the combustion chamber 1, and with an actuator 8 with which the drum dryer is run. The actuator consists of a motor and a roller 10 which have been arranged so that they can rotate the drum dryer. The device also has a fan for blowing air onto the grate and a discharge screw for removing ashes from the combustion chamber.

When using the device in accordance with the invention, the fuel is automatically transported to a silo or a tank, and from there, using the feed screw, to the beginning of the involuted spiral 6. The rotational frequency of the motors and fans of the feed screw and the drum dryer is, when necessary, automatically adjusted according to how much heat is needed. Accordingly, ash discharging and moving of the fire grate are automatically adjusted to the amount of burning fuel. The fuel is moved forward in the drum dryer with the help of a spiral, resulting in that the fuel dries and gasifies when inside the rolling drum dryer.

From the drum dryer 5 the fuel drops down to the upper end of the fire grate 2 which then shifts the combusting, partly charred fuel further downwards. The fan blows primary air through the grate into the fuel bed. The fire in the grate heats the drum dryer above it, heating and partly gasifying the contents in it. Primary air can also be blown into the drum dryer.

The device can be attached as a sequel to a convection device in which the gases can be burned completely using secondary air and then cooled down using an economizer. The device is also applicable as a front end furnace, for example, for an oil vessel. Water-cooling can be mounted around the device, thus making it a part of the entire vessel.

The invention is not only limited to the inexpensive applications presented herein, but may be varied within the framework of the inventive idea as presented in the patent claims.

I claim:

1. A device for combustion of moist fuel, comprising:

a combustion chamber, a fire grate placed inside the combustion chamber, on top of which fire grate the fuel is burned, feeding apparatus for feeding fuel into the combustion chamber, a discharge channel for removing flue gas from the combustion chamber and, a drum dryer including an inner part with an involuted spiral which is attached to the feeding apparatus, wherein said drum dryer is located substantially entirely inside the combustion chamber with a substantial extent of said drum dryer being located above the fire grate, said drum dryer being constructed and arranged to drop the fuel into the fire grate, wherein the fire grate is mounted in a diagonal position and a head of the drum dryer in the combustion chamber reaches a position where it is above the upper end of the fire grate, thus making the fuel shift downwards from where it is being fed.

2. A device as claimed in claim 1, characterized in that the wherein the involuted spiral is directed towards an end of the drum dryer within the combustion chamber.

3. A device as claimed in claim 1 or 2, including bearers for the drum dryer mounted outside the combustion chamber and an actuator for running the drum dryer.

4. A device as claimed in any of claims 1 or 2, wherein the fire grate includes several components in a step-by-step arrangement which are movable for shifting the fuel from one component to another.

5. A device as claimed in claim 3, wherein the fire grate includes several components in a step-by-step arrangement which are movable for shifting the fuel from one component to another.

6. A device as claimed in claim 1, wherein the fire grate is made of components which step-by-step extend downward within the combustion chamber and are attached to an endless band, and said device further includes an actuator for moving said endless band.

* * * * *